US010308479B2

(12) United States Patent
Zerelles et al.

(10) Patent No.: US 10,308,479 B2
(45) Date of Patent: Jun. 4, 2019

(54) ELEVATOR INSTALLATION

(71) Applicant: ThyssenKrupp Elevator AG, Essen (DE)

(72) Inventors: Holger Zerelles, Leinfelden-Echterdingen (DE); Bernd Altenburger, Neuhausen (DE); Ronald Dietze, Leinfelden-Echterdingen (DE); Juri Schäfer, Stuttgart (DE)

(73) Assignee: THYSSENKRUPP ELEVATOR AG, Essen (DE)

( * ) Notice: Subject to any disclaimer, the term of this patent is extended or adjusted under 35 U.S.C. 154(b) by 194 days.

(21) Appl. No.: 15/025,382

(22) PCT Filed: Sep. 29, 2014

(86) PCT No.: PCT/EP2014/002637

§ 371 (c)(1),
(2) Date: Mar. 28, 2016

(87) PCT Pub. No.: WO2015/043758

PCT Pub. Date: Apr. 2, 2015

(65) Prior Publication Data

US 2016/0236905 A1 Aug. 18, 2016

(30) Foreign Application Priority Data

Sep. 30, 2013 (DE) ..... 10 2013 110 791

(51) Int. Cl.
*B66B 7/06* (2006.01)
*B66B 9/00* (2006.01)

(52) U.S. Cl.
CPC ..... *B66B 7/06* (2013.01); *B66B 9/00* (2013.01); *B66B 2009/006* (2013.01)

(58) Field of Classification Search
CPC . B66B 7/06; B66B 2009/006; B66B 11/0095; B66B 7/10
See application file for complete search history.

(56) References Cited

U.S. PATENT DOCUMENTS 4,117,908 A * 10/1978 Nara ..... B66B 7/06 187/254
5,025,893 A * 6/1991 Saito ..... B66B 7/06 187/266

(Continued)

FOREIGN PATENT DOCUMENTS

CA 976888 A 10/1975
CN 101090856 A 12/2007

(Continued)

OTHER PUBLICATIONS

English abstract of JPH11139718.

(Continued)

*Primary Examiner* — Diem M Tran
(74) *Attorney, Agent, or Firm* — thyssenkrupp North America, Inc.

(57) ABSTRACT

An example elevator system may include a shaft in which at least one elevator car can be vertically displaced. The elevator car may be coupled to a counterweight via a cable arrangement wherein the cable arrangement has at least one cable portion. Horizontal deflection of the cable portion can be limited by at least one limiting member. In some examples, the at least one limiting member may be configured as a limiting roller that is mounted laterally alongside the cable portion such that it can be rotated about an axis of rotation and can be made to rotate by a controllable rotary drive that depends on a speed and a movement direction of the cable portion.

4 Claims, 4 Drawing Sheets

(56) References Cited

U.S. PATENT DOCUMENTS

| | | | | |
|---|---|---|---|---|
| 5,584,364 | A * | 12/1996 | Sakita | B66B 7/06 187/249 |
| 9,359,172 | B2 * | 6/2016 | Mangini | B66B 5/021 |
| 2008/0093177 | A1 | 4/2008 | Fargo | |
| 2011/0005867 | A1 | 1/2011 | Kocher | |
| 2011/0031069 | A1 | 2/2011 | Kocher | |

FOREIGN PATENT DOCUMENTS

| | | | |
|---|---|---|---|
| CN | 101903278 | A | 12/2010 |
| DE | 2313639 | A | 10/1974 |
| DE | 2255528 | C | 4/1978 |
| DE | 68902587 | T | 1/1993 |
| JP | H11139718 | A | 5/1999 |
| JP | 2007119131 | A | 5/2007 |
| WO | 9217396 | A1 | 10/1992 |
| WO | 2009080478 | A | 7/2009 |

OTHER PUBLICATIONS

English machine translation of DE2313639A.
International Search Report for PCT/EP2014/002637 dated Dec. 11, 2014 (dated Dec. 19, 2014).

* cited by examiner

ELEVATOR INSTALLATION

CROSS REFERENCE TO RELATED APPLICATIONS

This application is a U.S. National Stage Entry of International Patent Application Serial Number PCT/EP2014/002637, filed Sep. 29, 2014, which claims priority to German Patent Application No. DE 102013110791.5 filed Sep. 30, 2013, the entire contents of both of which are incorporated herein by reference.

FIELD

The present disclosure relates to elevator systems that employ counterweights.

BACKGROUND

A variety of different configurations of elevator systems having at least one elevator car and at least one counterweight are known. The at least one elevator car can be displaced vertically upward and downward in the shaft by means of a cable arrangement or a belt arrangement. The cable arrangement or belt arrangement may be guided over a traction sheave which, together with a drive motor which makes the traction sheave rotate, forms a drive device for the elevator car. In order to compensate for its weight, the elevator car is coupled to a counterweight via the cable arrangement or belt arrangement.

If such elevator systems are used in very high buildings, then the cable arrangement or belt arrangement has a very great length. This may result in the cable arrangement or belt arrangement being caused to vibrate for example by movement of the building in which the elevator system is installed. Building movements of this kind can be brought about by wind loading or, for example, also by earthquakes. The vibration results in the cable arrangement or belt arrangement being deflected in the horizontal direction. There is a risk here of a cable portion or belt portion colliding with a component of the elevator system, and so the cable portion or belt portion or also the component of the elevator system might be damaged.

In order to limit horizontal deflection of a cable portion or belt portion, WO 92/17396 proposes the use of a limiting member which can be pivoted about a horizontal pivot axis and can be positioned laterally on a cable portion or belt portion in order to limit the horizontal deflection of the same. If the limiting member is positioned laterally alongside a cable portion or a belt portion as the elevator car is travelling upward or downward, then it may be the case that the cable portion or belt portion executes a movement relative to the limiting member and slides along the limiting member. This, in turn, may result in the cable portion or belt portion working the limiting member mechanically. The limiting member therefore has to have a high level of mechanical strength in order to avoid damage. Moreover, it is also possible for the cable portion or belt portion to be damaged if it slides along the limiting member.

Therefore, a need exists for elevator systems that prevent damage to limiting members or cable or belt portions in the event a cable or belt portion is deflected horizontally.

DETAILED DESCRIPTION

Figure 1:
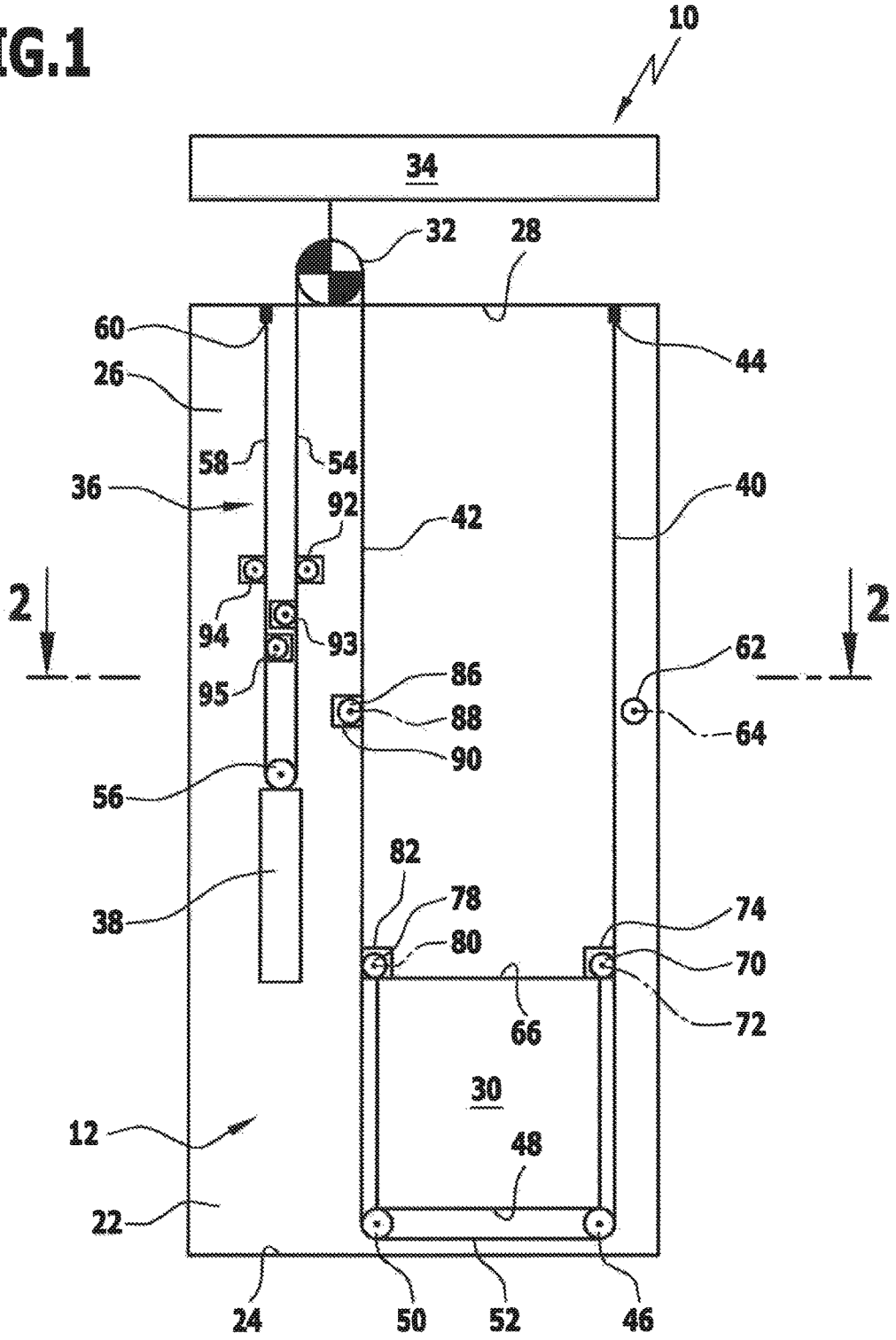
FIG. 1 is a schematic longitudinal-sectional view of an example elevator system.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents.

Example elevator systems of the present disclosure may generally include a shaft in which at least one elevator car can be displaced vertically upward and downward and is coupled to a counterweight via a cable arrangement or belt arrangement, wherein the cable arrangement or belt arrangement has at least one cable portion or belt portion, of which the horizontal deflection can be limited by at least one limiting member. Those having ordinary skill in the art will understand that the terms 'cable' and 'belt' may be used interchangeably herein.

Furthermore, some example elevator systems include at least one limiting member configured in the form of a limiting roller which is mounted laterally alongside a cable portion or belt portion such that it can be rotated about an axis of rotation. In some cases, the limiting roller can be made to rotate by a controllable rotary drive in dependence on the speed and the movement direction of the cable portion or belt portion, arranged laterally alongside the limiting roller, relative to the axis of rotation of the limiting roller.

In order to limit vibration of a cable portion or belt portion, use is made, in the case of the elevator system according to the invention, of at least one limiting roller which is mounted in a rotatable manner and can be made to rotate by a rotary drive. This makes it possible to reduce the speed of the cable portion or belt portion, arranged laterally alongside the limiting roller, relative to the limiting roller when the elevator car is traveling. For this purpose, the controllable rotary drive can make the limiting roller rotate in dependence on the speed and the movement direction of the cable portion or belt portion relative to the axis of rotation of the limiting roller. For example, provision may be made for the circumferential speed of the limiting roller which, in the event of vibration, comes into contact with the cable portion or belt portion arranged laterally alongside the limiting roller to be approximated by the rotary drive to the relative speed of said cable portion or belt portion, wherein the limiting-roller contact region against which the cable portion or belt portion can be positioned during horizontal deflection moves upward or downward in the same direction as the cable portion or belt portion. The cable portion or belt portion and the contact region of the limiting roller thus have the same movement direction. The greater the approximation of the speeds, the lower is the speed at which the cable portion or belt portion moves relative to the contact region of the limiting roller. This reduces the risk of the cable portion or belt portion and/or the limiting roller being damaged. The greater the speed of the cable portion or belt portion relative to the axis of rotation of the limiting roller, the greater is also the circumferential speed of the limiting roller which is made to rotate by the controllable rotary drive. The controllable rotary drive can move the limiting roller in the clockwise direction and counter-clockwise direction.

In the case of the elevator system according to the invention, the direction of rotation and the circumferential speed of the limiting roller used for limiting vibration of a cable portion or belt portion arranged laterally alongside the limiting roller can be adapted to the speed and the movement direction of said cable portion or belt portion relative to the axis of rotation of the limiting roller. As a result, if the cable portion or belt portion executes a horizontal deflection, and comes into contact with the outer circumference of the adjacent limiting roller, when the elevator car is traveling, the cable portion or belt portion moves, at most, at low speed relative to the outer circumference of the limiting roller, and therefore neither the limiting roller nor the cable portion or belt portion are badly damaged.

It is particularly advantageous if the circumferential speed of the limiting roller corresponds to the speed of the cable portion or belt portion, arranged laterally alongside the limiting roller, relative to the axis of rotation of the limiting roller. In the event of horizontal deflection, the cable portion or belt portion comes into contact with the outer circumference of the limiting roller. If the limiting roller is made to rotate by its rotary drive such that the circumferential speed of the limiting roller is identical to the speed of the cable portion or belt portion relative to the axis of rotation of the limiting roller, then, when the two come into contact, the cable portion or belt portion rolls on the outer circumference of the limiting roller without this resulting in sliding movement and mechanical working of the limiting roller. Damage to the limiting roller and/or to the cable portion or belt portion can thus be reliably prevented.

It is advantageous if the rotary drive, which makes the limiting roller rotate, is coupled to an elevator-control apparatus, wherein the elevator-control apparatus can supply the rotary drive with a control signal which is dependent on the speed and the movement direction of the cable portion or belt portion, arranged laterally alongside the limiting roller, relative to the axis of rotation of the limiting roller. The elevator-control apparatus controls the travel of the elevator car and also advantageously determines the speed and the movement direction of a cable portion or belt portion, arranged laterally alongside a limiting roller, relative to the axis of rotation of the limiting roller. On the basis of the relative speed determined, in particular calculated, and of the relative-movement direction determined, in particular calculated, the elevator-control apparatus can supply the rotary drive of the limiting roller with a control signal, which causes the rotary drive to drive the limiting roller to rotate such that the direction of rotation and circumferential speed thereof are adapted to the relative speed, and the direction of the relative movement, of the adjacent cable portion or belt portion. During operation of the elevator system, it is thus possible for the circumferential speed and the direction of rotation of the limiting roller to be changed in accordance with the change in relative speed, and the change in direction of movement, of the adjacent cable portion or belt portion.

In the case of an advantageous embodiment of the invention, at least one limiting roller is mounted in a rotatable manner in a predetermined position in the shaft. For example, provision may be made for at least one limiting roller to be arranged in the center of the shaft, as seen in relation to the vertical extent of the shaft.

Provision may also be made for the elevator system to have a plurality of limiting rollers distributed uniformly in the shaft in a region between the uppermost stop of the at least one elevator car and the lowermost stop of the at least one elevator car.

Provision may also be made for at least one limiting roller to be mounted in a rotatable manner on an elevator car. Such a positioning of at least one limiting roller on an elevator car is advantageous, in particular, when a cable portion or belt portion is guided along said elevator car. In the event of vibration of the cable portion or belt portion, it is possible here for the at least one limiting roller to limit deflection in the direction of the elevator car, and therefore the cable portion or belt portion cannot adversely affect the elevator car even if vibration occurs.

It is advantageous if the at least one limiting roller arranged on an elevator car has its circumferential region, which comes into contact with a cable portion or belt portion in the event of lateral deflection, projecting laterally beyond a side wall of the elevator car. Such positioning ensures that, in the case of horizontal deflection, the cable portion or belt portion extending laterally alongside the elevator car can come into contact, at most, with the circumferential region of the limiting roller, but not with the side wall.

It is preferable for at least one limiting roller to be mounted in a rotatable manner laterally alongside a cable portion or belt portion which extends in the vertical direction to a counterweight. This cable portion or belt portion may be a suspension-cable or suspension-belt portion which extends vertically upward from the counterweight. As an alternative, or in addition, it may also be a compensating-cable or compensating-belt portion which extends vertically downward from the counterweight. It is particularly advantageous if limiting rollers are mounted in a rotatable manner on mutually opposite sides of the cable portion or belt portion extending to the counterweight.

In the case of an advantageous configuration of the invention, at least one elevator car is arranged between two cable portions or belt portions, wherein at least one limiting roller is arranged laterally alongside each of the two cable portions or belt portions. The two cable portions or belt portions may be oriented with point symmetry with respect to one another, as seen in relation to a center axis of the elevator car. By supplying in each case at least one limiting roller in order to limit any lateral deflection of the cable portions or belt portions, it is possible to ensure in a straightforward manner in design terms that the elevator car positioned between the two cable portions or belt portions cannot be adversely affected by the cable portions or belt portions even when the latter are caused to vibrate.

Provision may be made, for example, for the elevator car to be suspended on the two cable portions or belt portions. In the case of such a configuration, the two cable portions or belt portions form suspension means, on which the elevator car is retained. For the purpose of suspending the elevator car on the cable portions or belt portions, it is possible for laterally outwardly projecting suspension elements to be retained on the elevator car. The suspension elements used may be, for example, fastening elements which each secure a cable end or belt end on the elevator car. As an alternative, it is also possible to use rotatable or non-rotatable suspension rollers, around which the cable portions or belt portions are guided. Starting from the suspension means, the cable portions or belt portions extend vertically upward and, in the event of vibration, lateral deflection of the cable portions or belt portions can be limited with the aid of limiting rollers.

In the case of a particularly preferred configuration of the invention, the elevator system has a first elevator car and a second elevator car, which is arranged beneath the first elevator car, the two elevator cars being displaceable vertically upward and downward separately from one another in the shaft and being coupled to a counterweight in each case via a cable arrangement or belt arrangement, wherein at least one cable arrangement or belt arrangement has two cable portions or belt portions which extend vertically in the shaft, from one of the two elevator cars, along mutually opposite sides of the other elevator car, which is arranged between the two cable portions or belt portions, wherein at least one limiting roller is mounted in a rotatable manner laterally alongside each of the cable portions or belt portions in the shaft and/or on the elevator car arranged between the two cable portions or belt portions.

The transporting capacity of the elevator system can be increased by supplying two elevator cars which are arranged one above the other in a shaft and can be displaced vertically upward and downward, separately from one another, along a common track. The two elevator cars are each assigned a drive device with a traction sheave, which can help to drive the respective elevator car. Each of the two elevator cars is assigned a counterweight, to which the elevator car is coupled via a cable arrangement or belt arrangement.

Elevator systems having two elevator cars arranged one above the other in a shaft are used, in particular, in very high buildings. As already explained, it is precisely in such buildings that there is a risk of cable portions or belt portions being caused to vibrate, which results in the cable portions or belt portions being deflected horizontally. In the case of two elevator cars coupled to a counterweight in each case via a cable arrangement or a belt arrangement being arranged one above the other, at least one of the two elevator cars is advantageously positioned between two cable portions or belt portions and, in order to avoid damage to the elevator car and/or to the cable portions or belt portions running along mutually opposite sides of the elevator car, each of the cable portions or belt portions is assigned at least one limiting roller which limits lateral deflection of the cable portion or belt portion and is mounted in a rotatable manner in the shaft or also on the elevator car.

It is particularly advantageous if at least two limiting rollers, each positioned alongside a cable portion or belt portion, are mounted in a rotatable manner on the two elevator cars.

Provision may be made for in each case two limiting rollers to be mounted in a rotatable manner on the upper side and on the underside of the elevator car arranged between the two cable portions or belt portions, said limiting rollers being arranged laterally alongside a cable portion or belt portion extending from the other of the two elevator cars. Supplying limiting rollers both on the upper side and on the underside of the elevator car arranged between the two cable portions or belt portions ensures that the cable portions or belt portions cannot come into contact with the elevator car even in the event of very pronounced vibration.

As already mentioned, the second elevator car is arranged beneath the first elevator car. It is advantageous if the second elevator car is suspended on two suspension-cable or suspension-belt portions which extend vertically upward from the second elevator car and between which the first elevator car is arranged, wherein each of the two suspension-cable or suspension-belt portions has arranged alongside it at least one limiting roller which is mounted in a rotatable manner on the first elevator car. By means of the limiting rollers mounted in a rotatable manner on the first elevator car, it is possible to limit the extent to which the suspension-cable or suspension-belt portions extending vertically upward from the second elevator car are deflected horizontally in the direction of the first elevator car.

Limiting rollers which are arranged on those sides of the suspension-cable or suspension-belt portions which are directed away from the two elevator cars are advantageously mounted in a rotatable manner in the shaft in each case alongside a suspension-cable or suspension-belt portion. By means of the limiting rollers mounted in a rotatable manner in the shaft, it is thus possible to limit horizontal deflection of the suspension-cable or suspension-belt portions in the directions away from the elevator cars and, by means of the limiting rollers mounted in a rotatable manner on the first elevator car, it is possible to limit deflection of the suspension-cable or suspension-belt portions in the direction of the first elevator car.

It is advantageous if rotatably mounted limiting rollers are arranged on mutually opposite sides of at least one suspension-cable or suspension-belt portion.

In the case of an advantageous configuration of the invention, the limiting rollers mounted in a rotatable manner on the first elevator car are arranged on the upper side thereof.

As an alternative, provision may be made for the limiting rollers mounted in a rotatable manner on the first elevator car to be arranged on the underside thereof.

It is particularly advantageous if limiting rollers which limit horizontal deflection of the suspension-cable or suspension-belt portions extending vertically upward from the second elevator car are arranged both on the upper side and on the underside of the first elevator car.

Provision may also be made, in addition to the limiting rollers mounted in a rotatable manner on the first elevator car, for rotatably mounted limiting rollers which limit horizontal deflection of the suspension-cable or suspension-belt portions extending vertically upward from the second elevator car also to be arranged on the second elevator car.

In particular in the case of very high buildings, and correspondingly very long suspension-cable or suspension-belt arrangements, it is advantageous if the weight of each suspension-cable or suspension-belt arrangement is compensated for by a compensating-cable or compensating-belt arrangement. In the case of such a configuration, each elevator car is coupled to its counterweight via a suspension-cable or suspension-belt arrangement and, in addition, via a compensating-cable or compensating-belt arrangement. The suspension-cable or suspension-belt arrangement is guided over a traction sheave arranged above the two elevator cars and the compensating-cable or compensating-belt arrangement is guided over a deflecting device arranged beneath the two elevator cars.

In the case of an advantageous configuration of the invention, the first elevator car is coupled to a counterweight via two compensating-cable or compensating-belt portions, wherein the compensating-cable or compensating-belt portions extend vertically downward from the first elevator car and the second elevator car is arranged between the two compensating-cable or compensating-belt portions, and wherein each of the compensating-cable or compensating-belt portions has arranged alongside it at least one limiting roller which is mounted in a rotatable manner on the second elevator car. In the case of such a configuration, at least two limiting rollers which are mounted in a rotatable manner on the second elevator car are used for the purpose of limiting horizontal deflection of the compensating-cable or compensating-belt portions between which the second elevator car is arranged.

It is advantageous if limiting rollers which are positioned on those sides of the compensating-cable or compensating-belt portions which are directed away from the two elevator cars are arranged in the shaft in each case alongside a compensating-cable or compensating-belt portion. By means of the limiting rollers arranged in the shaft, it is thus possible to limit lateral deflection of the compensating-cable or compensating-belt portions in the directions away from the elevator cars and, by means of the limiting rollers mounted in a rotatable manner on the second elevator car, it is possible to limit horizontal deflection of the compensating-cable or compensating-belt portions in the direction of the second elevator car.

It is advantageous if rotatably mounted limiting rollers are arranged on mutually opposite sides of at least one compensating-cable or compensating-belt portion.

In the case of an advantageous configuration of the invention, the limiting rollers mounted in a rotatable manner on the second elevator car and limiting lateral deflection of a compensating-cable or compensating-belt portion are mounted in a rotatable manner on the upper side of the second elevator car.

As an alternative, provision may be made for limiting rollers to be mounted in a rotatable manner on the underside of the second elevator car, for the purpose of limiting lateral deflection of the compensating-cable or compensating-belt portions guided along the second elevator car.

It is particularly advantageous if limiting rollers which are arranged a lateral deflection of the compensating-cable or compensating-belt portions extending vertically downward from the first elevator car are mounted in a rotatable manner both on the upper side and on the underside of the second elevator car.

Provision may also be made, in addition to the limiting rollers mounted in a rotatable manner on the second elevator car, for rotatably mounted limiting rollers which limit horizontal deflection of the compensating-cable or compensating-belt portions extending vertically downward from the first elevator car also to be arranged on the first elevator car.

In particular also in the case of elevator systems having two elevator cars which can be displaced one above the other and separately from one another, it is advantageous if at least one limiting roller which extends vertically downward or upward to a counterweight is mounted in a rotatable manner in the shaft laterally alongside a cable portion or belt portion, as has already been explained above.

Figure 2:
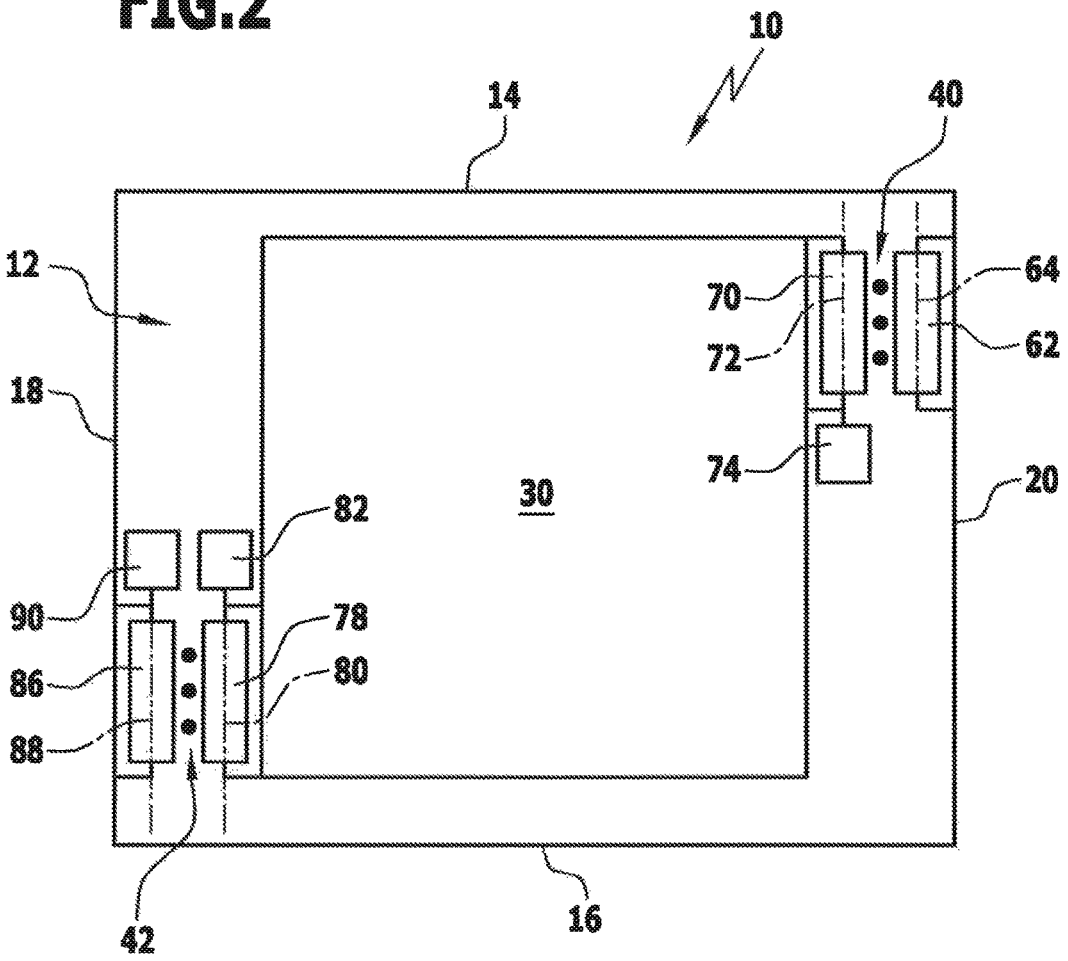
FIG. 2 is a cross-sectional view of the example elevator system taken across line 2-2 in FIG. 1.

FIGS. 1 and 2 illustrate, schematically, a first advantageous embodiment of an elevator system according to the invention, which is designated as a whole by the reference sign 10. The elevator system 10 comprises a shaft 12 with a rear wall 14, a front wall 16 and a first side wall 18 and a second side wall 20. The shaft 12 extends in the vertical direction from a shaft pit 22, which is limited vertically downward by a shaft floor 24, up to a shaft head 26, which is limited vertically upward by a shaft ceiling 28.

An elevator car 30 can be displaced vertically upward and downward in the shaft 12 along guide rails which are known per se and therefore, to give a better overview, are not illustrated in the drawing. For the purpose of driving the elevator car 30, use is made of a drive device having a traction sheave 32, which can be made to rotate by a drive motor (not illustrated in the drawing). The drive motor of the traction sheave 32 is connected to an elevator-control apparatus 34, which controls the elevator system 10.

The elevator car 30 is coupled to a counterweight 38 via a suspension-cable arrangement 36. Instead of a suspension-cable arrangement 36, it would also be possible, as an alternative, to use a suspension-belt arrangement.

The suspension-cable arrangement 36 is guided over the traction sheave 32 and comprises a first suspension-cable portion 40 and a second suspension-cable portion 42, on which the elevator car 30 is suspended. The elevator car 30 is positioned between the two suspension-cable portions 40, 42, wherein the two suspension-cable portions 40, 42 extend along mutually opposite sides of the elevator car. Starting from a first cable end 44, which is secured on the shaft ceiling 28, the first suspension-cable portion 40 extends vertically downward to a first suspension roller 46, which is mounted in a rotatable manner, facing toward the second side wall 20 of the shaft 12, on the underside 48 of the first elevator car 30. A second suspension roller 50 is mounted in a rotatable manner, facing toward the first side wall 18 of the shaft 12, on the underside 48 of the elevator car 30. A connecting portion 52 of the suspension-cable arrangement 36 runs in the horizontal direction essentially diagonally along the underside 48 and connects the first suspension-cable portion 40 to the second suspension-cable portion 42, which follows the second suspension roller 50 in the vertically upward direction and extends to the traction sheave 32. From the traction sheave 32, a third suspension-cable portion 54 runs to a deflecting roller 56, which is mounted in a rotatable manner on an upper side of the counterweight 38. Starting from the first deflecting roller 56, a fourth suspension-cable portion 58 extends vertically upward to a second cable end 60, which is secured on the shaft ceiling 28.

For the purpose of limiting horizontal deflection of the first suspension-cable portion 40 in the direction of the second side wall 20, a first limiting roller 62 is mounted such that it can be rotated about a first axis of rotation 64 approximately centrally, as seen in the vertical direction, in the shaft. The first limiting roller 62 is arranged on that side of the first suspension-cable portion 40 which is directed toward the second side wall 20, and therefore horizontal deflection of the first suspension-cable portion 40 in the direction of the second side wall 20 can be limited by means of the first limiting roller 62.

In order also to limit lateral deflection of the first suspension-cable portion 40 in the direction away from the second side wall 20, a second limiting roller 70 is mounted such that it can be rotated about an axis of rotation 72 on the upper side 66 of the elevator car 30, and laterally alongside the first suspension-cable portion 40. The first suspension-cable portion 40, which is fixed on the shaft ceiling 28, does not execute any vertical movement relative to the first limiting roller 62. In the event of vibration, the first suspension-cable portion 40 can thus come into contact with the first limiting roller, but does not slide along the first limiting roller, and therefore the risk of damage to the first limiting roller 62 by the first suspension-cable portion 40 is low. In contrast to this, the first suspension-cable portion 40 moves relative to the second limiting roller 70, which is mounted in a rotatable manner on the elevator car 30, when the elevator car 30 is traveling upward or downward. In order to avoid the first suspension-cable portion sliding along the second limiting roller 70, and damaging the second limiting roller 70, in the event of horizontal deflection, the second limiting roller 70 is assigned a rotary drive in the form of a controllable electric motor 74, with the aid of which the second limiting roller 70 can be made to rotate about the axis of rotation 72. The electric motor 74 is connected to the elevator-control apparatus 34 via a control line which, to give a better overview, is not illustrated in the drawing. As explained in yet more detail hereinbelow the circumferential speed and the direction of rotation of the second limiting roller 70 can be adapted to the speed and the movement direction of the first suspension-cable portion 40 by means of the electric motor 74.

A third limiting roller 78 is mounted such that it can be rotated about an axis of rotation 80 on the upper side of the elevator car 30, on the side directed away from the second limiting roller 70. The third limiting roller 78 is assigned a controllable rotary drive in the form of an electric motor 82, with the aid of which the third limiting roller 78 can be made to rotate about the third axis of rotation 80. The third electric motor 82 is connected to the elevator-control apparatus 34 via a control line (not illustrated in the drawing).

Level with the first limiting roller 62, a fourth limiting roller 86 is mounted such that it can be rotated about an axis of rotation 88 on the first side wall 18 of the shaft 12. The fourth limiting roller 86 is assigned a controllable rotary drive in the form of an electric motor 90, with the aid of which the fourth limiting roller 86 can be made to rotate about the fourth axis of rotation 88. The fourth electric motor 90 is likewise connected to the elevator-control apparatus 34 via a control line.

By means of the first limiting roller 62 and of the fourth limiting roller 86, it is possible to limit horizontal deflection of the two suspension-cable portions 40, 42 in the direction away from the elevator car 30 and, by means of the second limiting roller 70 and of the third limiting roller 78, it is possible to limit horizontal deflection of the two suspension-cable portions 40, 42 in the direction of the elevator car 30.

When the elevator car 30 moves in the vertical direction, the first suspension-cable portion 40 moves relative to the axis of rotation 72 of the second limiting roller 70 and the second suspension-cable portion 42 moves relative to the axis of rotation 80 of the third limiting roller 78 and also relative to the axis of rotation 88 of the fourth limiting roller 86. In order to avoid the first suspension-cable portion 40 sliding along the outer circumference of the second limiting roller 70, and this resulting in mechanical working of the second limiting roller 70 or of the first suspension-cable portion 40, during horizontal deflection, the circumferential speed and the direction of rotation of the second limiting roller 70 can be adapted by the controllable electric motor 74 to the relative speed and movement direction of the first suspension-cable portion 40 relative to the axis of rotation 72 of the second limiting roller 70. Consequently, the outer circumference of the second limiting roller 70 rolls on the first suspension-cable portion 40 without this resulting in any relative movement between the first suspension-cable portion 40 and the outer circumference of the second limiting roller 70. For the purpose of controlling the circumferential speed in dependence on the relative speed and movement direction of the first suspension-cable portion 40, the electric motor 74 is supplied with an appropriate control signal by the elevator-control apparatus 34.

When the elevator car 30 moves, the first suspension-cable portion 40 does not execute any vertical movement relative to the first limiting roller 62. The first limiting roller 62 thus does not require any rotary drive to adapt its circumferential speed and direction of rotation to the speed and movement direction of the first suspension-cable portion 40 relative to the axis of rotation 64 of the first limiting roller 62.

However, adaptation of the circumferential speed and of the direction of rotation to the relative speed and movement direction of the second suspension-cable portion 42 takes place for the third limiting roller 78 and for the fourth limiting roller 86. For this purpose, the circumferential speeds and direction of rotations of the third limiting roller 78 and of the fourth limiting roller 86 can be adapted to the relative speed and the movement direction of the second suspension-cable portion 42 when the elevator car 30 moves relative to the axis of rotation 80 of the third limiting roller 78 and/or relative to the axis of rotation 88 of the fourth limiting roller 86. For this purpose, the electric motors 82 and 90 of the third limiting roller 78 and of the fourth limiting roller 86 are supplied with appropriate control signals by the elevator-control apparatus 34. Consequently, when the elevator car 30 moves, the second suspension-cable portion 42 rolls on the outer circumference of the third limiting roller 78 and also on the outer circumference of the fourth limiting roller 86. Damage to the third limiting roller 78 and to the fourth limiting roller 86 can thus be reliably prevented.

The arrangement of the limiting rollers 62, 70, 78 and 86 is clear, in particular, from FIG. 2, in which, to give a better overview, the counterweight 38 is not illustrated.

Further limiting rollers 92, 93, 94 and 95 are mounted in a rotatable manner in the shaft 12 on either side of the third and fourth suspension-cable portions 54, 58. Like the limiting rollers 70, 78, 86 explained above, it is also possible for the limiting rollers 92-95 to be made to rotate in each case by a controllable electric motor such that the direction of rotation and circumferential speed thereof corresponds to the movement direction and the relative speed of the suspension-cable portions 54 and/or 58. Horizontal deflection of the suspension-cable portions 54, 58, which extend in the vertical direction to the counterweight 38, can thus be limited without the suspension-cable portions 54, 58 or the limiting rollers 92-95 being damaged.

Figure 3:
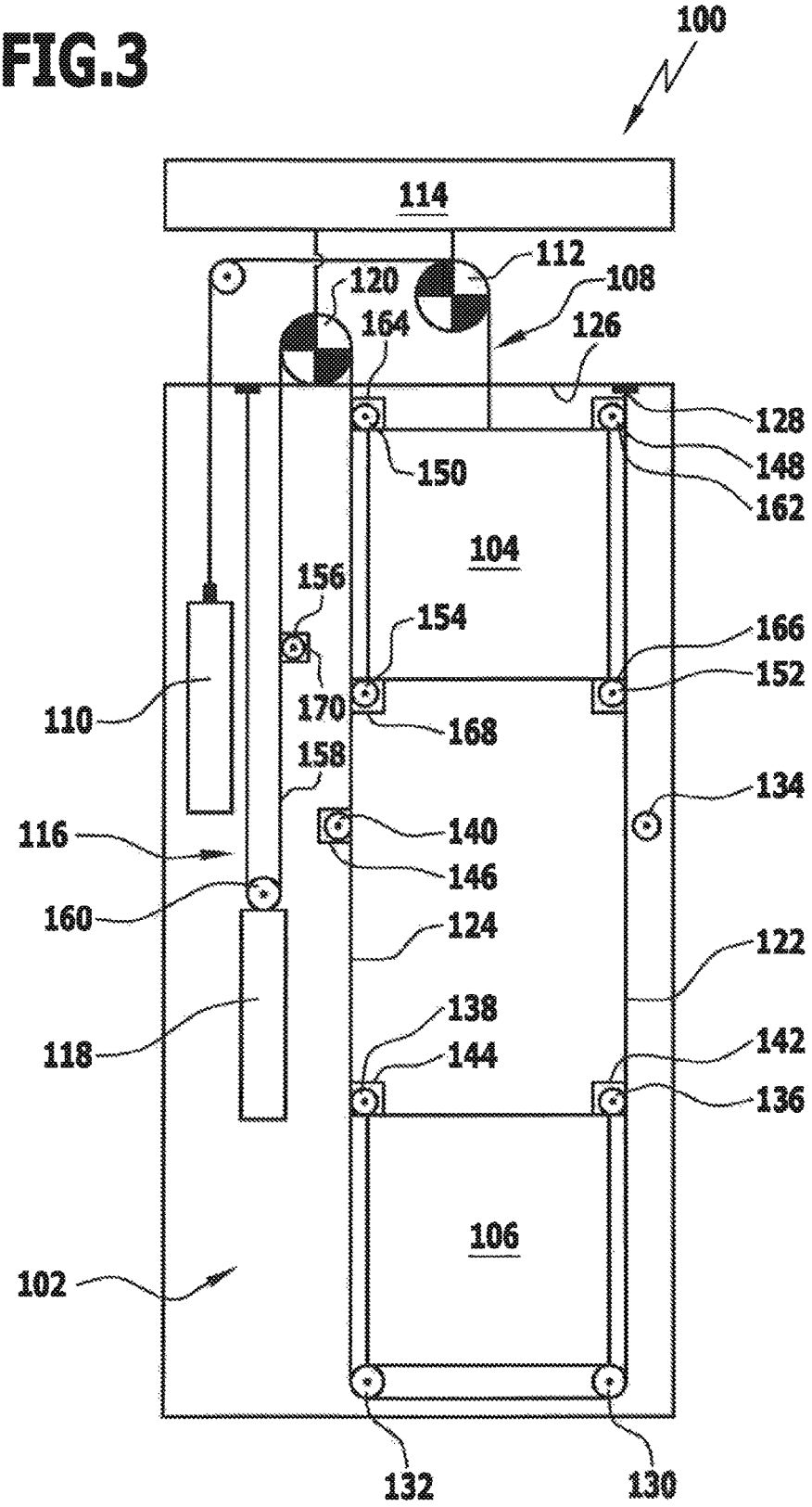
FIG. 3 is a schematic view of an example elevator system.

A second advantageous embodiment of an elevator system according to the invention is illustrated schematically in FIG. 3 and designated as a whole by the reference sign 100. The elevator system 100 has a shaft 102 in which a first elevator car 104 and a second elevator car 106, which is arranged beneath the first elevator car 104, can be displaced vertically upward and downward, separately from one another, along common guide rails, which, to give a better overview, are not illustrated in the drawing.

The first elevator car 104 is coupled to a first counterweight 110 via a first suspension-cable arrangement 108, wherein the first suspension-cable arrangement 108 is guided over a first traction sheave 112, which can be made to rotate by a drive motor (not illustrated in the drawing) for the purpose of displacing the first elevator car 104. The first traction sheave 112 is controlled by means of an elevator-control apparatus 114.

The second elevator car 106 is coupled to a second counterweight 118 via a second suspension-cable arrangement 116. The second suspension-cable arrangement 116 is guided over a second traction sheave 120, which can be made to rotate by a drive motor (not illustrated in the drawing). The second traction sheave 120 is likewise controlled by means of the elevator-control apparatus 114.

In a manner corresponding to the suspension-cable arrangement 36 explained above with reference to FIGS. 1 and 2, it is also the case that the second suspension-cable arrangement 116 of the elevator system 10 has a first suspension-cable portion 122 and a second suspension-cable portion 124. The first suspension-cable portion 122 extends in the vertical direction from a first cable end 128, which is secured on the ceiling 126 of the shaft 102, to a first suspension roller 130, which is arranged on the underside of the second elevator car 106, and the second suspension-cable portion 124 extends in the vertical direction from a second suspension roller 132, which is arranged on the underside of the second elevator car 106, to the second traction sheave 120.

The first elevator car 104 is arranged between the first suspension-cable portion 122 and the second suspension-cable portion 124. In order to restrict vertical deflection of the first suspension-cable portion 122 and of the second suspension-cable portion 124, the elevator system 100 illustrated in FIG. 3 makes use, in a manner corresponding to the elevator system 10 illustrated schematically in FIGS. 1 and 2, of a first limiting roller 134, a second limiting roller 136, a third limiting roller 138 and a fourth limiting roller 140, wherein the second limiting roller 136, the third limiting roller 138 and the fourth limiting roller 140 can be made to rotate in each case by an associated rotary drive in the form of a controllable electric motor 142, 144 and 146 in dependence on the relative speed and the movement direction of the first suspension-cable portion 122 and the second suspension-cable portion 124 in relation to the axis of rotation of the respective limiting rollers 134, 136 and 138, 140. For this purpose, the electric motors 142, 144, 146 are connected to the elevator-control apparatus 114 via control lines (not illustrated in FIG. 3). The elevator-control apparatus 114 supplies the electric motors 142, 144 and 146 with control signals which are dependent on the speed and the movement direction of the first suspension-cable portion 122 relative to the axis of rotation of the second limiting roller 136 and of the second suspension-cable portion 124 relative to the axes of rotation of the third limiting roller 138 and of the fourth limiting roller 140. As already explained, this can ensure that the first suspension-cable portion 122 can roll on the outer circumference of the second limiting roller 136, and that the second suspension-cable portion 124 can roll on the outer circumference of the third limiting roller 138 and of the fourth limiting roller 140.

In addition to the limiting rollers 134, 136, 138 and 140, the elevator system 100 makes use of five further limiting rollers 148, 150, 152, 154 and 156. In each case two limiting rollers 148, 150 are mounted in a rotatable manner on an upper side of the first elevator car 104, and two further limiting rollers 152, 154 are mounted in a rotatable manner on the underside of the first elevator car 104. A further limiting roller 156 is mounted in a rotatable manner in the shaft 102 laterally alongside a third suspension-cable portion 158, which, in a manner corresponding to the third suspension-cable portion 54 explained above with reference to FIG. 1, extends between the second traction sheave 120 and a deflecting roller 160, which is mounted in a rotatable manner on the upper side of the second counterweight 180.

The limiting rollers 148, 150, 152, 154 and 156 can be made to rotate in each case by a controllable rotary drive in the form of an electric motor 162, 164, 166, 168 and 170, wherein the circumferential speed and the direction of rotation of the limiting rollers 148, 150, 152, 154 and 156 corresponds in each case to the relative speed and the movement direction of the suspension-cable portion 122, 124 and 158, which comes into contact with the respective limiting roller in the event of horizontal deflection, relative to the axis of rotation of the respective limiting roller. For this purpose, it is also the case that the electric motors 162, 164, 166, 168 and 170 are connected to the elevator-control apparatus 114 via control lines (not illustrated in FIG. 3), said elevator-control apparatus supplying the aforementioned electric motors with control signals in dependence on the relative speed and movement direction of the suspension-cable portions 122, 124 and 158.

In the case of the elevator system 100, horizontal deflection of the suspension-cable portions 122, 124 and 158 can thus be limited by means of the limiting rollers 134, 136, 138, 140, 148, 150, 152, 154 and 156, which are arranged laterally alongside the suspension-cable portions 122, 124 and 158, without the risk of the limiting rollers and/or suspension-cable portions being damaged.

Figure 4:
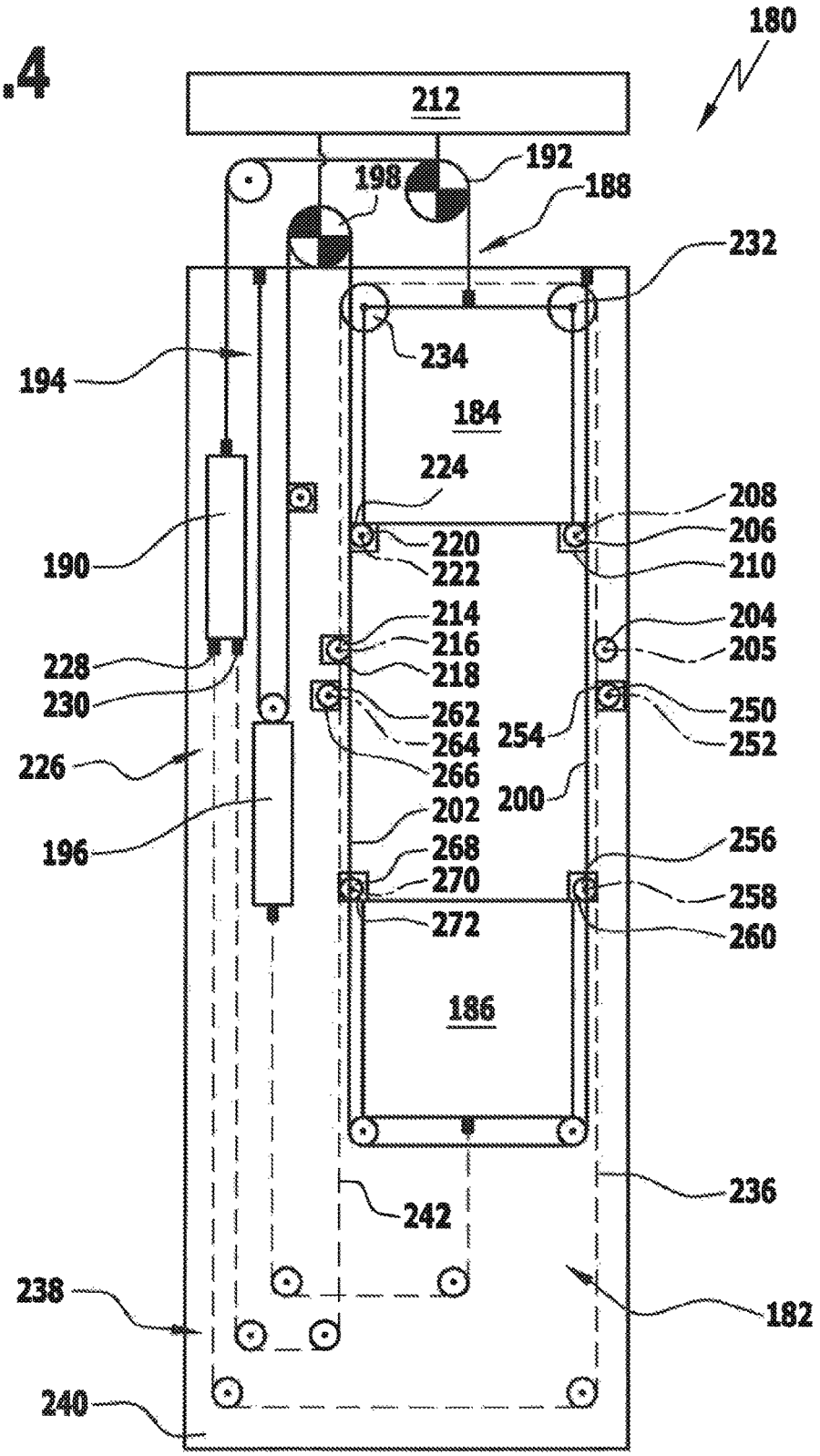
FIG. 4 is a schematic view of another example elevator system.

FIG. 4 illustrates schematically a third advantageous embodiment of an elevator system according to the invention, which is designated as a whole by the reference sign 180. In a manner corresponding to the elevator system 100 illustrated above with reference to FIG. 3, it is also the case that the elevator system 180, which is illustrated in FIG. 4, has a shaft 182 in which a first elevator car 184 and a second elevator car 186, which is arranged beneath the first elevator car 184, can be displaced vertically upward and downward separately from one another. The first elevator car 184 is coupled to a first counterweight 190 via a first suspension-cable arrangement 188, wherein the first suspension-cable arrangement 188 is guided over a first traction sheave 192, and the second elevator car 186 is coupled to a second counterweight 196 via a second suspension-cable arrangement 194, wherein the second suspension-cable arrangement 194 is guided over a second traction sheave 198.

In a manner corresponding to the second elevator car 106 explained above with reference to FIG. 3, it is also the case that the second elevator car 186 of the elevator system 180 is suspended on a first suspension-cable portion 200 and a second suspension-cable portion 202 and the first elevator car 184 assumes a position between the first suspension-cable portion 200 and the second suspension-cable portion 202.

In order to limit any horizontal deflection of the first suspension-cable portion 200, a first limiting roller 204 is mounted such that it can be rotated about an axis of rotation 205 approximately centrally, as seen in the vertical direction, in the shaft 182, on that side of the first suspension-cable portion 200 which is directed away from the elevator cars 184, 186, and a second limiting roller 206 is mounted such that it can be rotated about an axis of rotation 208 on the underside of the first elevator car 184, wherein the second limiting roller 206 is assigned a controllable rotary drive in the form of an electric motor 210, with the aid of which the second limiting roller 206 can be made to rotate in dependence on the speed and the movement direction of the first suspension-cable portion 200 relative to the axis of rotation 208 of the second limiting roller 206. The electric motor 210 is connected to an elevator-control apparatus 212 of the elevator system 180 via a control line (not illustrated in FIG. 4).

In order to limit any horizontal deflection of the second suspension-cable portion 202, a third limiting roller 214 is mounted such that it can be rotated about an axis of rotation 216 approximately centrally, as seen in the vertical direction, in the shaft, and said third limiting roller can be made to rotate by an electric motor 218 in dependence on the speed and the movement direction of the second suspension-cable arrangement 194 relative to the axis of rotation 216, and therefore the circumferential speed and the direction of rotation of the third limiting roller 214 are identical to the speed and the movement direction of the second suspension-cable portion 202 relative to the axis of rotation 216 of the third limiting roller 214. The third limiting roller 214 is arranged on that side of the second suspension-cable portion 202 which is directed away from the two elevator cars 184, 186.

A fourth limiting roller 220 is mounted such that it can be rotated about an axis of rotation 222 on the underside of the first elevator car 194, laterally alongside the second suspension-cable portion 202, wherein the fourth limiting roller 220 can be made to rotate by an associated electric motor 224 in dependence on the relative speed and the movement direction of the second suspension-cable portion 202 relative to the axis of rotation 222 of the fourth limiting roller 220.

The electric motor 224, like the electric motor 218, is connected to the elevator-control apparatus 212 via a control line (not illustrated in FIG. 4).

In order for it to be possible to compensate for the weight of the first suspension-cable arrangement 188, the first elevator car 184 is also coupled to the first counterweight 190 via a first compensating-cable arrangement 226. The compensating-cable arrangement 226 is secured on the underside of the first counterweight 190 by way of a first cable end 228 and by way of a second cable end 230 and is guided over a first deflecting roller 232 and a second deflecting roller 234, which are mounted in a rotatable manner on an upper side of the first elevator car 184. A first compensating-cable portion 236 here extends vertically downward from the first deflecting roller 232 to a cable-deflecting device 238, which is arranged in a pit 240 of the shaft 182, and a second compensating-cable portion 242 extends vertically downward from the second deflecting roller 234 to the cable-deflecting device 238.

The second elevator car 186, which is arranged beneath the first elevator car 184, is positioned between the first compensating-cable portion 236 and the second compensating-cable portion 242. In order to limit horizontal deflection of the first compensating-cable portion 236, a fifth limiting roller 250 is mounted such that it can be rotated about an axis of rotation 252 approximately centrally, as seen in the vertical direction, in the shaft 182, wherein the fifth limiting roller 250 is assigned a controllable rotary drive in the form of an electric motor 254. The electric motor 254 is connected to the elevator-control apparatus 212 via a control line (not illustrated in FIG. 4) and makes the fifth limiting roller 250 rotate such that the circumferential speed and direction of rotation of the fifth limiting roller 250 correspond to the relative speed and the movement direction of the first compensating-cable portion 236 relative to the axis of rotation 252 of the fifth limiting roller 250.

A sixth limiting roller 256 is mounted such that it can be rotated about an axis of rotation 258 on the upper side of the second elevator car 186. The sixth limiting roller 256 can be made to rotate by an electric motor 260 such that the circumferential speed and direction of rotation of the sixth limiting roller 256 correspond to the relative speed and movement direction of the first compensating-cable portion 236 relative to the axis of rotation 258.

In order for it to be possible to limit horizontal deflection of the second compensating-cable portion 242, a seventh limiting roller 262 is mounted such that it can be rotated about an axis of rotation 264 approximately centrally, as seen in the vertical direction, in the shaft 182, on that side of the second compensating-cable portion 242 which is directed away from the two elevator cars 184, 186, and said seventh limiting roller can be made to rotate by an electric motor 266, which is connected to the elevator-control apparatus 212 via a control line (not illustrated in FIG. 4), wherein the circumferential speed and the direction of rotation of the seventh limiting roller 262 correspond to the relative speed and movement direction of the second compensating-cable portion 252 relative to the axis of rotation 264 of the seventh limiting roller 262.

An eighth limiting roller 268 is mounted such that it can be rotated about an axis of rotation 270 on the upper side of the second elevator car 186, laterally alongside the second compensating-cable portion 242, and said eighth limiting roller can be made to rotate by an electric motor 272. The electric motor 272 is connected to the elevator-control apparatus 212 via a control line (not illustrated in FIG. 4) and makes it possible for the eighth limiting roller 268 to move in rotation such that the circumferential speed and direction of rotation of the eighth limiting roller 268 are identical to the relative speed and the movement direction of the second compensating-cable portion 242 relative to the axis of rotation 270 of the eighth limiting roller 268.

Horizontal deflection of the two suspension-cable portions 200, 202 can thus be limited by means of the limiting rollers 204, 206, 214 and 220, and horizontal deflection of the two compensating-cable portions 236, 242 can be limited by means of the limiting rollers 250, 256, 262 and 268. The limiting rollers are driven to rotate in each case such that the circumferential speed and the direction of rotation of the limiting rollers correspond to the relative speed and the movement direction of the respective suspension-cable or compensating-cable portion relative to the axis of rotation of the limiting roller when the elevator car is traveling. This ensures that the suspension-cable and compensating-cable portions roll on the circumferences of the limiting rollers without damaging these or themselves.

Further limiting rollers which, to give a better overview, are not illustrated in FIG. 4 are mounted in a rotatable manner in the shaft 182 in the region beneath the first counterweight 190 and the second counterweight 196 in order to limit horizontal deflection of the compensating cables extending in the vertical direction from the cable-deflecting device 238 to the counterweights 190, 196. Furthermore, it is also possible for limiting rollers which can help to limit horizontal deflection of the suspension cables extending in the vertical direction to the counterweights 190, 196 to be mounted in a rotatable manner in the shaft, above the two counterweights 190, 196. The limiting rollers which are mounted in a rotatable manner in the shaft both above and beneath the counterweights 190, 196 can be made to rotate in each case by a controllable electric motor such that their direction of rotation and their circumferential speed correspond to the movement direction and the relative speed of the respective suspension cable or compensating cable with which the respective limiting roller comes into contact during horizontal deflection.

What is claimed is:

1. An elevator system comprising:

a first elevator car;

a second elevator car disposed either above or below the first elevator car, wherein the first and second elevator cars are displaceable vertically upwards and downwards separately from one another in a shaft, wherein each of the first and second elevator cars is coupled to a counterweight via at least one cable arrangement, wherein at least one of the cable arrangements includes two cable portions that extend vertically in the shaft from one of the first and second elevator cars along mutually opposite sides of the other elevator car that is disposed between the two cable portions; and a limiting roller rotatably mounted laterally alongside each of the two cable portions in one or more of the shaft, on the first elevator car, or the second elevator car disposed between the two cable portions, wherein each limiting roller is spaced apart from a corresponding one of the two cable portions such that each limiting roller comes into contact with a respective one of the two cable portions only in the event of horizontal cable deflection.

2. The elevator system of claim 1 wherein at least two limiting rollers are rotatably mounted on the first and second elevator cars, wherein each of the at least two limiting rollers is positioned alongside the cable arrangements.

3. The elevator system of claim 1 wherein the second elevator car is suspended on two suspension-cable portions that extend vertically upward from the second elevator car and between which the first elevator car is disposed, wherein each of the two suspension-cable portions includes disposed alongside it at least one limiting roller rotatably mounted on the first elevator car.

4. The elevator system of claim 1 wherein the at least one cable arrangement coupling the first elevator car to the counterweight comprises two compensating-cable portions that extend vertically downwards from the first elevator car, wherein the second elevator car is disposed between the two compensating-cable portions, wherein each of the two compensating-cable portions has arranged alongside it at least one limiting roller rotatably mounted on the second elevator car.

* * * * *